United States Patent [19]

Cameron et al.

[11] 4,141,766

[45] Feb. 27, 1979

[54] SLURRY EXPLOSIVE COMPOSITION

[75] Inventors: Ian R. Cameron, Irvine; John Cooper, Ardrossan, both of Scotland

[73] Assignee: Imperial Chemical Industries Limited, London, England

[21] Appl. No.: 856,983

[22] Filed: Dec. 2, 1977

[30] Foreign Application Priority Data

Dec. 29, 1976 [GB] United Kingdom ..... 54238/76

[51] Int. Cl.[2] ..... C06B 45/00

[52] U.S. Cl. ..... 149/2; 149/21; 149/38; 149/47; 149/62; 149/76; 149/78

[58] Field of Search ..... 149/2, 88, 21, 38, 42, 149/43, 40, 41, 44, 47, 62, 76, 78

[56] References Cited

U.S. PATENT DOCUMENTS

| | | | |
|---|---|---|---|
| 3,681,156 | 8/1972 | Stevenston et al. | 149/88 X |
| 3,684,595 | 8/1972 | Craig et al. | 149/88 X |

*Primary Examiner*—Stephen J. Lechert, Jr.

*Attorney, Agent, or Firm*—Cushman, Darby & Cushman

[57] ABSTRACT

A slurry explosive composition comprising inorganic oxidizing salt and a liquid solvent, dispenser or carrier for the salt, which liquid is emulsified with a sensitizing liquid aliphatic mononitrate containing from 3 to 8 carbon atoms per molecule.

18 Claims, No Drawings

SLURRY EXPLOSIVE COMPOSITION

This invention relates to improved slurry explosive compositions of the kind containing a liquid alkyl nitrate as sensitiser in the liquid phase of the composition, and to a method of preparing said explosive composition.

Slurry explosives comprise inorganic oxidising salt, fuel and a liquid solvent, disperser or carrier for said salt. Although the term 'slurry' is applied to such compositions the degree of consistency may range from pourable to highly viscous extrudable gels. The oxidising salt generally comprises nitrate or perchlorate of ammonia, sodium potassium, calcium or barium, the most extensively used salt being ammonium nitrate.

The liquid content of slurry explosive is sufficient to maintain a continuous liquid phase which facilitates loading into boreholes or into paper or plastics containers to form blasting cartridges. The liquid phase may vary widely in its chemical constitution consistency and explosive sensitivity. Thus, in aqueous slurries, the liquid phase may consist mainly of an aqueous solution of inorganic oxidising salt but, non-aqueous slurry compositions are known wherein the liquid phase comprises a liquid chemical compound, which acts as fuel to contribute energy to the composition. Thickening agents, such as guar gum, dissolved in the liquid phase have been extensively used to increase the viscosity of slurry explosives, in order to prevent segregation of the ingredients and to prevent deterioration in wet conditions. Further improvements in the homogeneity and storage properties have been obtained by crosslinking the thickening agents with crosslinking agents, for example, potassium and sodium dichromates or potassium pyroantimonate. It is also common practice to improve the sensitivity of slurry explosive compositions by introducing voids to provide 'hot-spots' which are well known to facilitate initiation and propagation of detonation. Such voids may be introduced by mechanical mixing, preferably using a foaming surfactant in the composition, or by including gas filled spheres, or gas generating substances in the composition.

Fuel is included in the slurry explosive composition to combine with the oxygen from the oxidising salt and enhance the power and sensitivity of the composition. A wide variety of fuel materials have been used including coal, sugar, starch and metal powder. Whilst all fuels have a sensitising effect, some fuels have been found to be especially effective in this respect and have been widely used usually in combination with other cheaper fuel. Such sensitisers include solid materials such as finely divided metal powders and self-explosive materials such as trinitrotoluene and pentaerythritol tetranitrate. These metal powder sensitisers are difficult to disperse uniformly in the composition and the compositions tend to become less sensitive on storage. The self-explosive sensitisers are objectionable because they increase the risk of premature ignition of the explosive in handling.

Liquid non-self-explosive sensitising materials such as nitrobenzene and liquid nitrotoluene have been used but have been found to be difficult to hold in suspension in the slurry. More successful liquid sensitisers are the liquid aliphatic mononitrates containing from 3 to 8 carbon atoms, whose use is described in United Kingdom Patent Nos. 1,180,677 and 1,229,736. These liquid sensitisers, when uniformly dispersed, give well sensitised slurries at high density, but tend to separate from the slurry unless they are gelled with nitrocellulose and methyl or ethyl centralite. The gelled sensitiser is less effective and is, moreover, more difficult to disperse uniformly in the composition.

It is an object of this invention to provide an improved method of using liquid aliphatic mononitrate as sensitiser in slurry explosive compositions.

In accordance with this invention a slurry explosive composition comprises at least one inorganic oxidising salt, a liquid solvent, disperser or carrier for said salt and, as sensitising fuel, a liquid aliphatic mononitrate containing from 3 to 8 carbon atoms per molecule, said liquid mononitrate being emulsified with the liquid solvent, disperser or carrier for the inorganic oxidising salt. Compositions of the invention are easier to initiate to detonation and retain the aliphatic nitrate better on storage than corresponding compositions wherein the aliphatic nitrate is not emulsified.

The liquid aliphatic mononitrates containing from 3 to 8 carbon atoms are preferably alkyl mononitrates, which are insensitive compounds with only slight explosive character, although the propyl nitrates have been reported to have been detonated with difficulty.

Preferred nitrates include n-propyl nitrate, isopropyl nitrate, amyl nitrate, hexyl nitrate and octyl nitrate.

The liquid solvent, disperser or carrier for the inorganic salt will, in the more generally used compositions, be water but useful non-aqueous compositins can be prepared wherein the liquid comprises non-aqueous liquids, for example, diethylene glycol, formamide, dimethyl formamide, dimethysulphoxide or liquid mixtures containing one or more salts, for example, ammonium acetate, ammonium formate or an amine salt containing 1 to 6 carbon atoms, for example, methylamine nitrate or ethylene diamine dinitrate.

The emulsion may contain the liquid mononitrate either in its continuous or disperse phase depending on the emulsifier used to prepare the emulsion. Suitable oil-in-water type emulsifiers for preparing an emulsion with the mononitrate in the disperse phase include (a) condensates of polyalkylene oxide with a long chain alcohol containing 10 to 20 carbon atoms per molecule or with an alkyl phenol or alkyl phenol/formaldehyde resin in which phenol or resin the alkyl group contains 5 to 22 carbon atoms or with an amine or polyamine, for example, hexamethylene diamine, said condensates containing from 4 to 100 and preferably from 20 to 50 ethylene oxide groups per molecule; and (b) long chain amine oxides having chain lengths of 8 to 24 carbon atoms.

The long chain amine oxides cause foaming of the emulsion and are therefore advantageous for the production of sensitive low density slurry explosive.

Preferred polyalkylene oxide condensates include octylphenol or nonylphenol/polyethylene oxide condensates containing from 20 to 50 ethylene oxide groups per molecule and lauryl alcohol/polyethylene oxide condensates containing from 15 to 30 ethylene oxide groups per molecule.

Preferred amine oxides include N,N-dimethyl dodecylamine oxide, N,N-di(hydroxyethyl) dodecylamine oxide, bis(2-hydroxyethyl) cocoamine oxide and dimethyl cocoamine oxide.

Suitable water-in-oil type emulsifiers for preparing emulsions having the mononitrate in the continuous phase include alkyd condensates of polyethylene glycol with mono- or dicarboxylic acids wherein the Molecular Weight of the polyethylene glycol is in the range from 200 to 6,000. Optionally the condensates may also contain dihydric- or polyhydric alcohol.

Additional modifying surfactants may be included in the slurry explosive, for example, to control the emulsion droplet size. These surfactants include long chain amines, for example, dodecylamine, ethoxylated amines, for example, N,N-di(hydroxyethyl) dodecylamine, quaternary ammonium salts, for example, cetyl trimethyl ammonium chloride, long chain alkyl sulphate salts, for example, sodium dodecyl sulphate, alkylaryl sulphonic acid salts, for example, sodium dodecylbenzene sulphonate, long chain esters of monohydric or polyhydric alochols, for example, sorbitan trioleate, ethyoxylated esters of monohydric or polyhydric alcohols, and lignosulphonates, for example, sodium lignosulphonate.

The emulsion may also, if desired, contain an emulsion stabiliser to preserve the explosive in adverse conditions of handling and storage. Suitable emulsion stabilisers include long chain alcohols, for example, lauryl alcohol, polyalkylene oxide polymers, for example, an ethylene oxide/propylene oxide block copolymers and water-soluble cellulose or starch ethers, for example, methyl cellulose and hydroxypropyl cellulose.

Preferably the emulsion contains a thickening agent either in its continuous phase or dispersed phase or in both phases. Thus the aqueous emulsion phases may advantageously be thickened with the thickening agents normally used in aqueous slurry explosives including, for example, guar gum, hydroxypropylated guar gum, xanthan gum, starch, polyacrylamide and derivatives thereof, hydroxyethyl cellulose, polyethylene oxide or polyvinyl alcohol. These thickening agents may be crosslinked with alkali metal chromates or borates, titanium salts, potassium pyroantimonates or telluric acid. The aliphatic nitrate phase of the emulsion may be thickened by, for example, nitrocellulose, cellulose esters, polyacrylic esters or copolymers of styrene or alkyl styrene and maleic anhydride or other anhydride of an $\alpha\beta$-unsaturated dicarboxylic acid and these thickening agents may be crosslinked with metal alkoxides, for example, titanium tetra isopropoxide.

The aforedescribed emulsion is compatible with other methods of sensitising explosive slurries. Thus small voids may advantageously be included in the composition and these may be produced, for example, by including in the composition an aeration agent such as a foaming surfactant which entraps air during mixing, or a chemical gassing agent, for example, sodium nitrate, or hollow spheres. Advantageously sufficient voids are included in the composition to give the composition a density in the range 0.8 to 1.5 g/cc.

The inorganic oxidising salt may be present either as the liquid or dispersed solid phase or both phases of the slurry composition. Suitable oxidising salts include nitrates and perchlorates of ammonia, sodium, potassium, barium, magnesium or calcium and mixtures of any two or more of these salts.

The composition preferably comprises from 4 to 20% w/w of liquid alkyl mononitrate and from 5 to 25% w/w of liquid solvent, disperser or carrier, from 0.1 to 3.5% w/w of emulsifier, from 25 to 85% w/w of ammonium nitrate, from 0 to 35% w/w of other inorganic oxidising salt and optionally up to 20% of solid fuel.

The preferred solid fuel is metal powder, for example, aluminium or magnesium, although any of the commonly used solid fuels can be used.

The invention also includes a method of preparing a slurry explosive composition, which method comprises mixing inorganic oxidising salt with a liquid solvent disperser or carrier for said salt and, either before or after said mixing, emulsifying said liquid solvent, disperser or carrier with a liquid aliphatic mononitrate containing from 3 to 8 carbon atoms per molecule.

The invention is further illustrated by the following Examples in which all parts and percentages are by weight.

In the Examples the ammonium nitrate (AN) and sodium nitrate (SN) grades used have the sieve analysis given in the following Table.

TABLE

| Type | Dense Prill AN | Porous Prill AN | Fine Crystalline AN | Crystalline SN |
|---|---|---|---|---|
| % Passing | | | | |
| 8 Mesh BSS (2,055$\mu$) | 99 | 85 | 100 | 100 |
| 30 Mesh BSS (500$\mu$) | 24 | 5 | 98 | 30 |
| 100 Mesh BSS (150$\mu$) | 5 | 3.5 | 22 | 5 |
| 200 Mesh BSS (76$\mu$) | 2 | 2.5 | 2 | — |

The coarse aluminium powder used was atomised aluminium which all passed a 60 mesh BS sieve and 20% was retained on a 200 mesh BS sieve. The fine aluminium was atomised aluminium powder which all passed a 300 mesh BS sieve.

EXAMPLE 1

A solution was prepared from 9.6 parts of calcium nitrate and 9.8 parts of water. To this solution was added 15 parts of isopropyl nitrate and 1.5 parts of a commercial surfactant containing 70% of octyl phenoxy polyethoxy ethanol containing approximately 40 ethylene oxide groups per molecule and commercially available as Triton X405 (Registered Trade Mark). The resultant mixture was agitated vigorously for five minutes and an emulsion of the oil-in-water type formed. To this emulsion were added 61.8 parts of dense prill ammonium nitrate and a suspension of 0.7 parts guar gum and 0.2 parts zinc chromate in 1.4 parts of diethylene glycol and the emulsion was mixed for 1 minute. The resultant mixture was of pourable consistency which gelled after about 3 hours. It had density 1.33 g/cc and, when primed with 4 g pentolite (50/50 TNT/PETN), a 3¼" diameter cartridge detonated at a velocity of detonation of 3.3 km/second. The minimum diameter for propagation unconfined was 3".

The same composition prepared as described in this Example but without the emulsifier exuded isopropyl nitrate.

EXAMPLE 2

The procedure of Example 1 was repeated except that the surfactant used was a lauryl alcohol/ethylene oxide condensate containing 20 ethylene oxide groups per molecule. The resulting explosive had density 1.31 g/cc and, when primed with 4 g pentolite (50/50), a 3¼" diameter cartridge detonated at a velocity of detonation of 3.2 km/second.

EXAMPLE 3

A solution was prepared from 39.7 parts of ammonium nitrate, 28.8 parts of calcium nitrate, 10.0 parts of sodium nitrate, 4.0 parts ethylene glycol, 2.0 parts urea, 0.2 parts of guar gum, 0.3 parts thiourea and 15.0 parts water.

To 55.0 parts of the solution at 50° C. were added 8.0 parts isopropyl nitrate and 0.5 parts Triton X405 and the mixture was agitated to form an emulsion. 7.5 parts of coarse aluminium, 0.5 parts of starch, 28.3 parts of crushed porous prill ammonium nitrate, 0.2 parts of a 2:1 water/sodium nitrate solution and 0.01 parts of a 1:1 water/sodium dichromate solution were addded to the emulsion forming an initially pourable mix which gelled after 30 minutes. The explosive had density 1.22 g/cc and, when initiated by a detonator having a base charge of 0.4 g PETN, a 1¼" diameter cartridge of the mixture detonated at a velocity of detonation of 3.2 km/second.

EXAMPLE 4

A solution was prepared from 33.6 parts of ammonium nitrate, 10.4 parts calcium nitrate, 12.0 parts of water, 0.1 parts of guar gum and 0.1 parts thiourea.

To 56.2 parts of this solution at 50° C. were added 5.0 parts of isopropyl nitrate and 0.3 parts of Triton X405 and the mixture was agitated to form an emulsion. To this was added 33.59 parts of ammonium nitrate porous prills on which 3.7 parts of diesel oil had been absorbed, 0.5 parts of starch, 0.5 parts of guar gum, 0.2 parts of 1:2 sodium nitrite/water solution, and 0.01 parts 1:1 sodium dichromate/water solution.

The resulting explosive, after gelation, had density 1.25 g/cc and, when initiated with 28 g pentolite, a 3¼" diameter cartridge detonated. The minimum diameter for propagation unconfined was 3" at a velocity of detonation of 3.2 km/second.

EXAMPLE 5

45.05 parts of fine crystalline ammonium nitrate, 10.0 parts of sodium nitrate, 0.15 parts zinc chromate, 0.5 parts of guar gum, 0.2 parts of polyacrylamide, 0.1 parts mannitol, and 15.0 parts coarse aluminium powder were mixed. To this mixture were added 15.0 parts water, 10.0 parts isopropyl nitrate and 1.0 parts of Triton X405 and mixing was continued to emulsify the isopropyl nitrate. 3.0 parts of silane coated hollow glass microspheres ranging in particle size from 20 to 400 microns were added and incorporated by gentle mixing. The pH of the mixture was adjusted to 5.5 by zinc nitrate addition and the slurry was allowed to gel.

The gelled slurry had density 1.21 g/cc and, when initiated with 4 g pentolite at 15° C., a 2" diameter cartridge detonated at a velocity of detonation of 3.5 km/second. The minimum diameter for propagation unconfined was 1½".

A sample of the gelled slurry was confined in a 2" diameter 30" length steel tube and primed with 84 g pentolite under a hydrostatic pressure of 500 psi. On initiation of the primer the slurry detonated, as evidenced by complete rupture of the steel tube.

EXAMPLE 6

7.0 parts of isopropyl nitrate was added to a solution of 0.3 parts Triton X405 and 0.15 parts of sodium dodecylbenzene sulphonate in 6 parts of water, and mixed for 5 minutes. The resulting emulsion was mixed (for 5 minutes) with a pre-mix of 69.34 part of fine crystalline ammonium nitrate, 5.0 parts of sodium nitrate, 11.0 parts of coarse aluminium powder, 0.4 parts of hydroxypropylated guar gum and 0.3 parts of polyacrylamide and the mixture was allowed to stand for a further 5 minutes. A solution of 0.01 parts of chromic nitrate in 0.5 parts water was then added and mixed for 1 minute to give an extrudable composition. The white appearance of the mix and its low density 1.28 g/cc (whereas density 1.6 g/cc would be expected for the non-aerated composition) indicated the presence of small air bubbles in the mix.

When initiated by a detonator having a base charge of 0.4 g PETN, a 3¼" diameter cartridge detonated at a velocity of detonation 3.3 km/second. The minimum diameter for propagation unconfined was 1½".

EXAMPLE 7

To a liquid prepared from 45.0 parts of ammonium nitrate, 20.0 parts sodium nitrate, 15.0 parts of ammonium acetate and 20.0 parts formamide heated sufficiently to prevent any crystal precipitation, were added 0.4 parts of hydroxypropylated guar gum which was allowed to solvate.

7.0 parts of isopropyl nitrate and 1.0 part Triton X405 were added to 30 parts of the liquid and mixed to form an oil-in-water type emulsion. A pre-mix of 52.5 parts of fine crystalline ammonium nitrate, 5.0 parts of sodium nitrate and 4.0 parts of coarse aluminium was then mixed with the emulsion. A crosslinker consisting of 0.1 parts zinc chromate was added to the mixture. The mixture had gelled after 24 hours. The density was 1.44 g/cc and, when initiated with 8 g pentolite (50/50) a 3¼" diameter cartridge detonated at a velocity of detonation of 3.4 km/second.

EXAMPLE 8

A liquid (for the slurry liquid phase) was prepared from 45.0 parts of ammonium nitrate, 20.0 parts of formamide, 10.0 parts of urea and 20.0 parts of ammonium formate.

To 33.3 parts of this liquid maintained above its crystallisation temperature were added 0.4 parts of hydroxypropylated guar gum which was allowed to solvate. To the resulting solution was then added 7.0 parts of isopropyl nitrate and 1.0 part Triton X405 and the mixture was agitated to form an emulsion. To this emulsion was added 26.0 parts of fine crystalline ammonium nitrate, 30.0 parts of sodium nitrate, 2.0 parts of coarse aluminium powder and 0.3 parts of zinc chromate. After the resulting explosive had gelled it had a density of 1.30 g/cc and, when initiated with 15 g pentolite (50/50), a 3¼" diameter cartridge detonated at a velocity of detonation of 3.2 km/second.

EXAMPLE 9

A liquid was prepared from 50.0 parts of ammonium nitrate, 20.0 parts of aluminium nitrate, 10.0 parts of calcium nitrate and 20.0 parts of formamide. An explosive was prepared in a manner similar to that described in Example 8 from 33.3 parts of the liquid, 54.0 parts of fine crystalline ammonium nitrate, 6.0 parts of isopropyl nitrate, 1.0 part of Triton X405, 0.5 parts of hydroxypropylated guar gum, 5.0 parts of coarse aluminium powder and 0.2 parts of zinc chromate. After gelation the explosive had density 1.40 g/cc and, when initiated with 8 g pentolite (50/50), 3¼" diameter cartridge detonated.

EXAMPLE 10

A liquid was prepared from 40.0 parts of ammonium nitrate, 20.0 parts of calcium nitrate, 20.0 parts formamide and 20.0 parts ethylene glycol.

An explosive was prepared in a manner similar to that described in Example 8 from 25.0 parts of the liquid, 53.1 parts of fine crystalline ammonium nitrate, 6.0 parts of isopropyl nitrate, 1.0 part of Triton X405, 3.0 parts of coarse aluminium powder, 0.5 parts of hydroxypropylated guar gum, 0.2 parts of zinc chromate and 11.2 parts of sodium nitrate. The density of this slurry explosive was 1.36 g/cc and, when initiated with 4 g pentolite (50/50), a 3¼" diameter cartridge detonated at 3.3 km/second.

EXAMPLE 11

A composition was prepared from 35.0 parts of the solution prepared in Example 3, 35.10 parts of fine crystalline ammonium nitrate, 10.0 parts of sodium nitrate, 1.0 part of starch, 0.5 parts of hydroxypropylated guar gum, 10.0 parts of isopropyl nitrate, 0.50 parts of bis(2-hydroxyethyl) cocoamine oxide, 7.89 parts of fine aluminium powder and 0.01 parts of 1:1 sodium dichromate/water solution. The mixing procedure was similar to that described in Example 3.

The composition after gelation had a density of 1.28 g/cc and, when initiated by a detonator having a base charge of 0.6 g PETN, a ¼" diameter cartridge detonated at a velocity of detonation of 3.8 km/second.

The emulsifier used in this Example also acted as a foaming agent and entrapped air bubbles into the composition during mixing thereby enhancing the sensitivity.

EXAMPLE 12

The procedure described in Example 11 was repeated except that the emulsifier used was dimethyl cocoamine oxide instead of bis(2-hydroxyethyl) cocoamine oxide, and the resulting explosive composition had the same properties as that prepared in Example 11.

EXAMPLE 13

A solution was prepared from 48.7 parts ammonium nitrate, 17.0 parts sodium nitrate and 17.0 parts water, and, while being maintained at a temperature above its crystallisation temperature, was slowly added with stirring to a mixture of 11.0 parts isopropyl nitrate and 3.0 parts of an alkyd condensate of 1 part pentaerythritol, 1 part glycerol, 2 parts polyethylene glycol (MW 600), 5 parts $C_{18}$ fatty acid and 2 parts trimellitic anhydride alkyd condensate. To the resultant water-in-oil type emulsion, in which isopropyl nitrate was the continuous phase, were added 3.0 parts of hollow glass microspheres and 0.3 parts of a copolymer of 30 parts t-butylstyrene, 4 parts methyl methacrylate and 3 parts methacrylic acid.

After gelation the resulting explosive had density 1:1 g/cc and, when initiated by a detonator having a base charge of 0.8 g PETN, a 3½" diameter cartridge detonated at 4.5 km/second.

EXAMPLE 14

8 parts of amyl nitrate were added to 10 parts of water and 0.5 parts of N,N-dimethyl dodecylamine oxide and mixed to form an emulsion. A pre-mix of 6 parts of coarse aluminium powder, 0.7 parts of guar gum, 0.02 parts of potassium pyroantimonate, 5.0 parts of sodium nitrate and 69.78 parts of fine crystalline ammonium nitrate was mixed with the emulsion, and the resulting slurry explosive, after gelation, had density 1.34 g/cc. When initiated with 12 g pentolite (50/50), a 3" diameter cartridge detonated. Separation of amyl nitrate occurred when the same composition was prepared without the emulsifier.

EXAMPLE 15

A slurry was prepared by the mixing procedure described in Example 14 from 8 parts n-propyl nitrate, 10.3 parts of water, 0.5 parts of N,N-di(hydroxyethyl) dodecylamine oxide, 9 parts of coarse aluminium powder, 0.7 parts of guar gum, 0.2 parts of zinc chromate, 5.0 parts of sodium nitrate and 66.3 parts of fine crystalline ammonium nitrate.

The resulting slurry explosive, after gelation, had density 1.30 g/cc and, when initiated with a detonator having a base charge of 0.8 g PETN, a 2¼" diameter cartridge detonated.

The same composition but without the emulsifier exuded n-propyl nitrate.

EXAMPLE 16

A slurry was prepared by the mixing procedure described in Example 14 from 7 parts of isopropyl nitrate, 10 parts of water, 0.5 parts of an ethoxylated octyl phenol/formaldehyde resin (the base resin of which had a Molecular Weight of approximately 900 and was ethoxylated with 4 molecules of ethylene oxide), 10 parts of coarse aluminium powder, 0.7 parts of guar gum, 0.2 parts of zinc chromate, 5 parts of sodium nitrate and 66.6 parts of fine ammonium nitrate. The resulting slurry had density 1.40 g/cc and, when initiated with 4 g of pentolite (50/50), a 3¼" diameter cartridge detonated.

EXAMPLE 17

The procedure described in Example 16 was repeated except that the ethoxylated octyl phenol/formaldehyde resin was replaced by hexamethylene diamine propoxylate of Molecular Weight Approximately 3,500 which had been condensed with 30% of its weight of ethylene oxide. The explosive properties of the resulting composition were the same as those of the composition prepared in Example 16.

EXAMPLE 18

The procedure described in Example 16 was repeated except that the ethoxylated phenol/formaldehyde resin was replaced by 0.1 parts of sodium dodecyl benzene sulphonate and 0.4 parts of a block copolymer containing 20% ethylene oxide and 80% propylene oxide and having a Molecular Weight of 2,500. The explosive properties of the resulting composition were the same as those of the composition prepared in Example 16.

EXAMPLE 19

The procedure described in Example 18 was repeated except that the sodium dodecyl benzene sulphonate was replaced by 0.1 parts of cetyl trimethyl ammonium chloride. The explosive properties of the resulting composition were the same as those of the composition prepared in Example 18.

EXAMPLE 20

The procedure described in Example 18 was repeated except that the sodium dodecyl benzene sulphonate was replaced by 0.1 parts of dodecylamine. The explosive properties of the resulting composition were the same as those of the composition prepared in Example 18.

EXAMPLE 21

The procedure described in Example 18 was repeated except that the sodium dodecyl benzene sulphonate was replaced by 0.1 parts of N,N-di(hydroxyethyl) dodecylamine. The explosive properties of the resulting composition were the same as those of the composition prepared in Example 18.

EXAMPLE 22

The procedure described in Example 6 was repeated except that the sodium dodecyl benzene sulphonate was replaced by 0.1 parts of sodium lignosulphonate. The explosive properties of the resulting slurry composition were the same as those of the composition prepared in Example 6.

EXAMPLE 23

A slurry was prepared by the mixing procedure described in Example 14 from 6 parts of isopropyl nitrate, 17 parts of methylamine nitrate solution (10 parts methylamine nitrate to 7 parts of water), 0.5 parts of an octyl phenoxy polyethoxy ethanol containing 40 ethylene oxide groups per molecule, 7 parts of coarse aluminium, 0.7 parts of guar gum, 0.2 parts of zinc chromate, 5 parts of sodium nitrate and 63.6 parts of fine ammonium nitrate. The resulting slurry explosive had density 1.35 g/cc and, when initiated with a detonation having a base charge of 0.8 g PETN, a 3¼" diameter cartridge detonated.

EXAMPLE 24

The procedure described in Example 3 was repeated except that the 0.2 parts of guar gum was replaced by a mixture of 0.2 parts guar gum and 0.15 parts of a xanthan gum "Biopolymer" XB 23 (Registered Trade Mark) commercially available from General Mills Inc. The resulting solution was thixotropic and gave improved emulsion stability compared with Example 3.

The resultant explosive had density 1.2 g/cc and when a 1¼" diameter cartridge was initiated by a detonator having a base charge of 0.3 g PETN it detonated at a velocity of detonation of 3.3 km/second.

What we claim is:

1. A slurry explosive composition comprising at least one inorganic oxidising salt, a liquid selected from the group consisting of solvents, dispersers and carriers for said salt and, as sensitising fuel, a liquid aliphatic mononitrate containing from 3 to 8 carbon atoms per molecule, said liquid mononitrate being emulsified with the said liquid by means of an emulsifier.

2. A composition as claimed in claim 1 wherein the liquid aliphatic mononitrate comprises an alkyl mononitrate.

3. A composition as claimed in claim 1 wherein the liquid aliphatic mononitrate is selected from the group consisting of n-propyl nitrate, isopropyl nitrate, amyl nitrate, hexyl nitrate and octyl nitrate.

4. A composition as claimed in claim 1 wherein the said liquid solvent, disperser or carrier is selected from the group consisting of water, diethylene glycol, formamide, dimethyl formamide, dimethylsulphoxide and liquid mixtures containing at least one salt.

5. A composition as claimed in claim 4 wherein the said liquid mixtures each contain a salt selected from the group consisting of ammonium acetate, ammonium formate, methylamine nitrate and ethylenediamine dinitrate.

6. A composition as claimed in claim 1 wherein the emulsifier is selected from the group consisting of (a) condensates of polyalkylene oxide with a compound selected from the group consisting of long chain alcohols containing 10 to 20 carbon atoms per molecule, alkyl phenols and alkyl phenol/formaldehyde resins in which phenols and resins the alkyl group contains 5 to 22 carbon atoms, amines and polyamines, said condensates containing from 4 to 100 alkylene oxide groups per molecule, (b) long chain amine oxides having a chain length of 8 to 24 carbon atoms and (c) alkyd condensates of polyethylene glycol with an acid selected from the group consisting of monocarboxylic acids and dicarboxylic acids in which condensates the Molecular Weight of the polyethylene glycol is in the range from 200 to 6,000.

7. A composition as claimed in claim 6 wherein the emulsifier is selected from the group consisting of condensates of polyethylene oxide with a compound selected from the group consisting of octylphenol and nonylphenol said condensates containing from 20 to 50 ethylene oxide groups per molecule, condensates of polyethylene oxide with lauryl alcohol containing from 15 to 30 ethylene oxide groups per molecule, N,N-dimethyl dodecylamine oxide, N,N-di(hydroxyethyl) dodecylamine oxide, bis(2-hydroxyethyl) cocoamine oxide, dimethyl cocoamine oxide and alkyd condensates of polyethylene glycol, an acid and an alcohol selected from the group consisting of dihydric- and polyhydric alcohols.

8. A composition as claimed in claim 6 comprising additionally a modifying surfactant to control the emulsion droplet size, said modifying surfactant being selected from the group consisting of long chain amines, ethoxylated amines, quaternary ammonium salts, long chain alkyl sulphate salts, alkylaryl sulphonic acid salts, lignosulphonates and long chain esters of alcohols selected from the group consisting of monohydric and polyhydric alcohols, and ethoxylated esters of alcohols selected from the group consisting of monohydric and polyhydric alcohols.

9. A composition as claimed in claim 8 wherein the modifying surfactant is selected from the group consisting of dodecylamine, N,N-di(hydroxyethyl) dodecylamine, cetyl trimethyl ammonium chloride, sodium dodecyl sulphate, sodium dodecylbenzene sulphonate, sorbitan trioleate and sodium lignosulphonate.

10. A composition as claimed in claim 6 comprising additionally an emulsion stabiliser selected from the group consisting of long chain alcohols, polyalkylene oxide polymers, water-soluble cellulose ethers and starch ethers.

11. A composition as claimed in claim 10 wherein the emulsion stabiliser is selected from the group consisting of lauryl alcohol, ethylene oxide/propylene oxide block copolymers, methyl cellulose and hydroxypropyl cellulose.

12. A composition as claimed in claim 1 comprising additionally a thickening agent selected from the group consisting of guar gum, hydroxypropylated guar gum, xanthan gum, starch, polyacrylamide and derivatives thereof, hydroxyethyl cellulose, polyethylene oxide, polyvinyl alcohol, nitrocellulose, cellulose esters, polyacrylic esters, and copolymers of styrene and alkyl styrene with $\alpha\beta$-unsaturated dicarboxylic acids.

13. A composition as claimed in claim 12 wherein the thickening agent is crosslinked with a compound selected from the group consisting of alkali metal chromates, alkali metal borates, titanium salts, potassium pyroantimonate, telluric acid and metal alkoxides.

14. A composition as claimed in claim 1 comprising an aeration agent selected from the group consisting of foaming surfactants, chemical gassing agents and hollow spheres.

15. A composition as claimed in claim 14 comprising sufficient voids to give the composition a density in the range 0.8 to 1.5 g/cc.

16. A composition as claimed in claim 1 wherein the oxidising salt is selected from the group consisting of nitrates and perchlorates of ammonia, sodium, potassium, barium, magnesium and calcium and mixtures containing at least two of the said salts.

17. A composition as claimed in claim 1 comprising from 4 to 20% by weight of liquid mononitrate, from 5 to 25% by weight of the said liquid, from 0.1 to 3.5% by weight of emulsifier, from 25 to 85% by weight of ammonium nitrate, from 0 to 35% by weight of oxidising salt other than ammonium nitrate and from 0 to 20% of solid fuel.

18. A composition as claimed in claim 17 wherein the solid fuel comprises metal powder.

* * * * *